United States Patent [19]

Sandstrom

[11] Patent Number: 4,744,441

[45] Date of Patent: May 17, 1988

[54] SCREW-TYPE LADDER LEVELER

[76] Inventor: Bruce D. Sandstrom, 888 Burke Ave., Roseville, Minn. 55113

[21] Appl. No.: 900,002

[22] Filed: Aug. 25, 1986

[51] Int. Cl.[4] ..... E06C 7/44
[52] U.S. Cl. ..... 182/111; 182/201
[58] Field of Search ..... 182/204, 201, 111; 248/188.9, 188.4, 188.5

[56] References Cited

U.S. PATENT DOCUMENTS

| | | | |
|---|---|---|---|
| 766,210 | 8/1904 | Young | 182/111 |
| 1,179,391 | 4/1916 | Bachman | 248/188.5 |
| 2,362,170 | 11/1944 | Swaisgood | 182/17 |

FOREIGN PATENT DOCUMENTS

| | | | |
|---|---|---|---|
| 820207 | 11/1951 | Fed. Rep. of Germany | 182/201 |
| 901224 | 7/1962 | United Kingdom | 182/205 |

*Primary Examiner*—Reinaldo P. Machado

[57] ABSTRACT

A device for leveling a metal ladder comprising a mounting bracket which can be attached to the outside web of a ladder side rail, a threaded shaft embodied with a handle at its upper distal end and a convex semi-shperical head at its lower distal end which is sized to operate within a threaded bore hole in the distal member of said mounting bracket in order to provide means to raise or lower a pivotable ladder foot embodied with a concave semi-spherical surface within the raised center portion of said foot in order to provide a pivoting means for said foot with respect to said threaded shaft.

1 Claim, 3 Drawing Sheets

SCREW-TYPE LADDER LEVELER

TECHNICAL FIELD

My invention relates generally to the art of ladders. More specifically, my invention relates to a leveling device embodied with a pivotable ladder foot which can be secured to the bottom of each of the side rails of a metal ladder so as to enable the user to level said ladder for use on uneven ground, thus providing the user with a safe and stable work environment.

BACKGROUND OF THE INVENTION

In the past, in order to provide a stable base for a ladder on uneven ground or where complex ground slopes exist, leveling devices have been embodied with a pivotable foot attached to the lower end of an adjustable shaft within a bracket attached to the base of each of the ladder side rails. Adjustability was achieved by raising said shaft to its desired elevation and locked into place by inserting a pin through one of a plurality of holes within said bracket and into said shaft or by moving a locking arm of said shaft into a plurality of horizontal slots within a mounting bracket. The rotation and tilt of the foot has typically been accomplished by the employment of either a ball and socket joint or a complex swivel joint at the juncture of the foot and the lower end of the adjustable shaft. A ladder leveling device of such design is shown, for example, in U.S. Pat. No. 2,620,115 issued Dec. 2, 1952 in the name of Oscar M. Guldjord. Another example of such art is shown in U.S. Pat. No. 4,423,797 issued Jan. 3, 1984 in the name of Lloyd E. Batten. One advantage of prior art is the number of component parts typically required to accomplish the purpose of a ladder leveling device. Another disadvantage is that the degree of adjustment between settings is limited to the spacing provided between the slots or holes within which the locking arm or pin is placed. Yet another disadvantage is that close tolerance machining is required to achieve pivotable capability within the foot, thus increasing cost of manufacturing and allowing the effects of corrosion to reduce the pivotable capability of said foot.

SUMMARY OF THE INVENTION

My invention consists of a ladder leveling device which is capable of being mounted on the lower end of each of the side rails of a metal ladder. The device is installed in a set of two, each being a duplicate of the other. Each device is comprised basically of an improved pivotable ladder foot attached in a unique manner to the lower end of a threaded shaft capable of operating within a threaded longitudinal bore formed within the distal end of a lateral member of a mounting bracket. The device is durable and features fewer component parts than prior related art.

One object of the present invention is to provide ladder foot which has a concave, semi-spherical surface which accepts the convex, semi-spherical head of a threaded shaft when in an engaged position, thus allowing the plane of the base of said foot to pivot and rotate with respect to the axis of said shaft.

Another object of the present invention is to provide a durable, but yet pivotal ladder foot whose operation is unaffected by intrusion of moisture or earthen material, such as sand, dirt or leaf debris.

Another object of the present invention is to provide a ladder foot with semi-cylindrical horizontal openings to allow the easy removal of foreign material that might become entrained within.

Still another object of the present invention is to provide a ladder leveling device with fewer component parts.

A further object of the present invention is to provide a ladder leveling device designed to allow the manufacture of its major components with cast metal technology.

A further object of the present invention is to provide a ladder leveling device which provides a smaller degree of integral adjustment by use of a threaded shaft to raise and lower a ladder foot.

Yet another object of the present invention is to provide a ladder leveling device of a single design which can be installed on either the right or left side rails of an aluminum ladder.

BRIEF DESCRIPTION OF THE DRAWINGS

For a better understanding of my invention, reference is made to the following description of an exemplary embodiment thereof and to the accompanying drawings wherein.

DETAILED DESCRIPTION OF THE INVENTION

Figure 1:
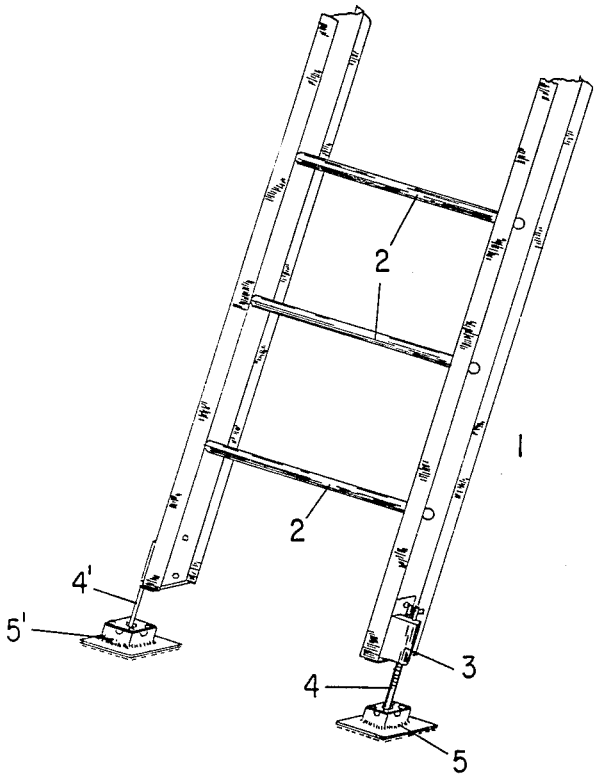
FIG. 1 is a partial perspective view of the lower portion of a metal ladder with I-beam side rails equipped with two screw-type ladder levelers, each accordng to my invention.
Figure 2:
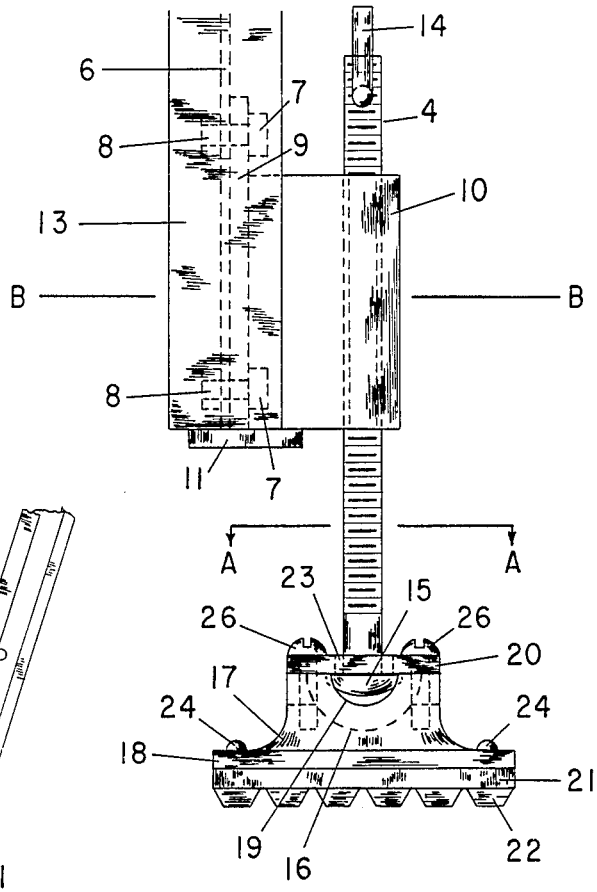
FIG. 2 is a front elevation view of the lower portion of the right leg of said ladder to which one of my ladder levelers is affixed wherein the threaded shaft and the ladder foot are shown in a disengaged position.
Figure 3:
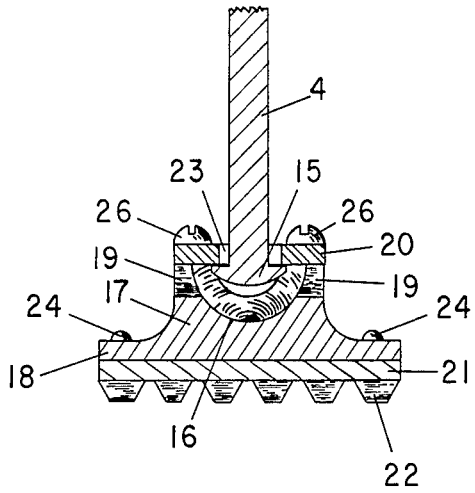
FIG. 3 is a front cross-sectional view taken at section A—A as shown in FIG. 2.
Figure 5:
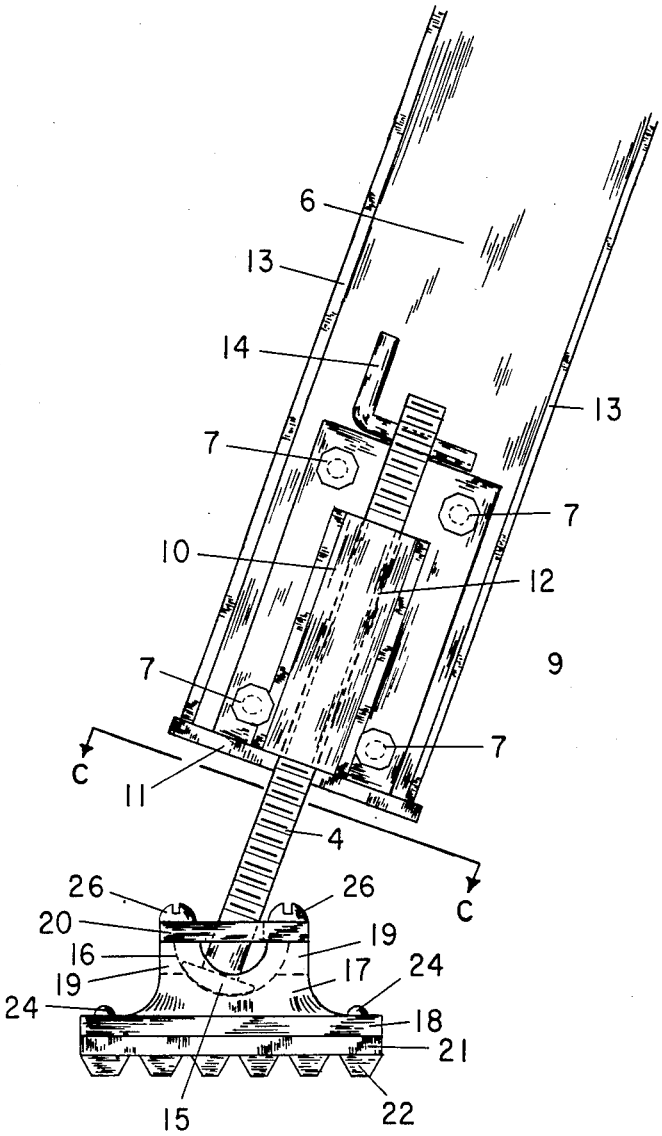
FIG. 5 is a right side elevation view wherein the threaded shaft and the ladder foot are in an engaged position.

Referring now to the drawings, FIG. 1 is a partial perspective view showing the lower portion of an aluminum or steel ladder with I-beam design side rails 1 and 1' with its attendant ladder rungs 2. Affixed to each of the right and left ladder side rails 1 and 1' is a device of my invention comprised principally of a mounting bracket 3 and 3', a threaded shaft 4 and 4', and a pivotable ladder foot 5 and 5' of which only the device on the right will be described in detail since each is a duplicate of the other.

As best shown in FIGS. 2, 3, 4, 5 and 6, the device of my invention is attached to the web 6 of the right ladder side rail 1 between the side flanges 13 of said side rail 1 by four mounting bolts 7 and attendant mounting nuts 8 through the back 9 of the metal mounting bracket 3. Said mounting bracket 3, comprised primarily of a back 9, a lateral member 10, and a base 11, all designed to enable its manufacture in one piece using cast metal technology. The base 11 of said mounting bracket 3 provides a means to distribute the load of the ladder side rail 1 upon said side flanges 13. The lateral member 10 of the mounting bracket 3 is embodied at its distal end with a threaded longitudinal bore 12 running parallel to the plane of the ladder side rail 1 through which the threaded shaft 4 screws up and down, thus providing the means to raise and lower the pivotable foot 5 attached to its lower end.

Said threaded shaft 4 is embodied with a handle 14 at its upper distal end and a convex semispherical head 15 at its lower distal end wherein said head 15 pivots and rotates within the concave semi-spherical surface 16 of the pivotable foot 5 when in an engaged position.

The main component of said pivotable foot 5 is embodied primarily with a raised member 17, a base 18, horizontal openings 19 near the top of said raised member 17 and a concave semi-spherical surface 16; all design to enable its manufacture in one piece using cast metal technology. All that is attached to the above described one-piece, cast metal portion of said pivotable foot 5 is a metal keeper plate 20 at its top and a resilient pad 21 embodied with resilient cleats 22 fastened to its bottom. Said resilient cleats 22 provide protection against slippage on a variety of surfaces.

The aforementioned concave semi-spherical surface 16 within the raised member 17 of the pivotable foot 5 has a radius of curvature similar to the radius of curvature of the convex semispherical head 15 of the aforementioned shaft 4. The metal keeper plate 20 is formed with a smooth longitudinal bore 23 at its center which is sized just large enough to allow said shaft 4 to pivot or rotate as much as 35 degrees from vertical in any direction, but still is small enough to prevent said head 15 of said shaft 4 from detaching from said pivotable foot 5. The metal keeper plate 20 is affixed to the raised member 17 of the ladder foot 5 by means of four threaded bolts 26 which screw into properly sized threaded bores. Alternate means of fastening of said keeper plate 20 to said raised member 17 would include welding, riveting or other similar fastening means. The resilient pad 21 and attendant resilient cleats 22 are affixed to the base 18 of the foot 5 by means of rivets 24.

Figure 6:
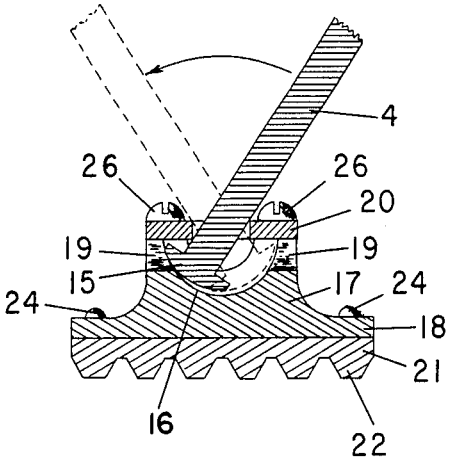
FIG. 6 is a side sectional view of the lower portion of the threaded shaft and the ladder foot taken at section C—C of FIG. 5, showing the pivotal movement of said shaft with respect to said foot.
Figure 4:
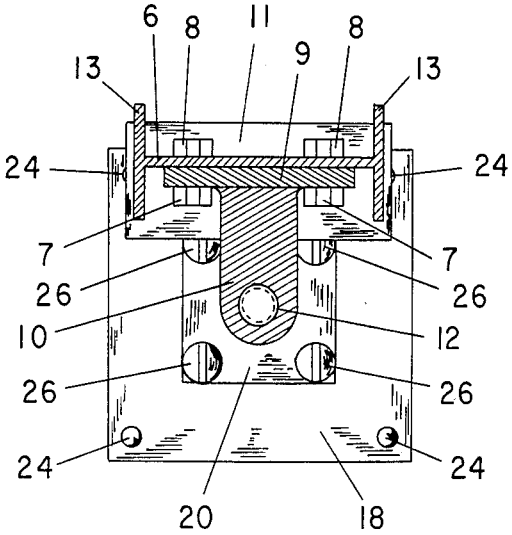
FIG. 4 is a top sectional view taken at section B—B of FIG. 2.

FIG. 6 depicts the mobility and contact of the threaded shaft 4 and its head 15 with respect to the cavity 16 within the foot 5 when in an engaged position.

Figure 7:
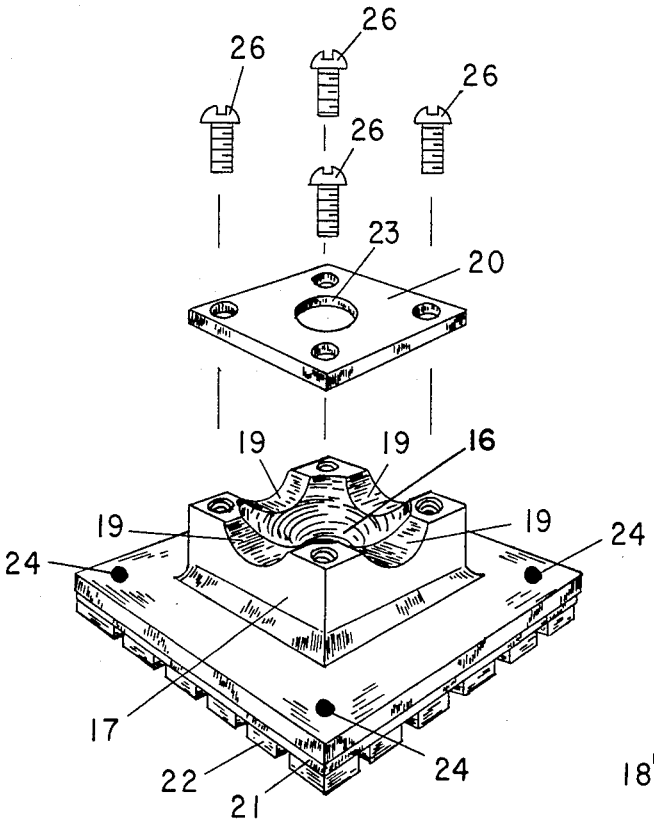
FIG. 7 is a partially exploded, perspective view showing various components of the ladder foot.
Figure 8:
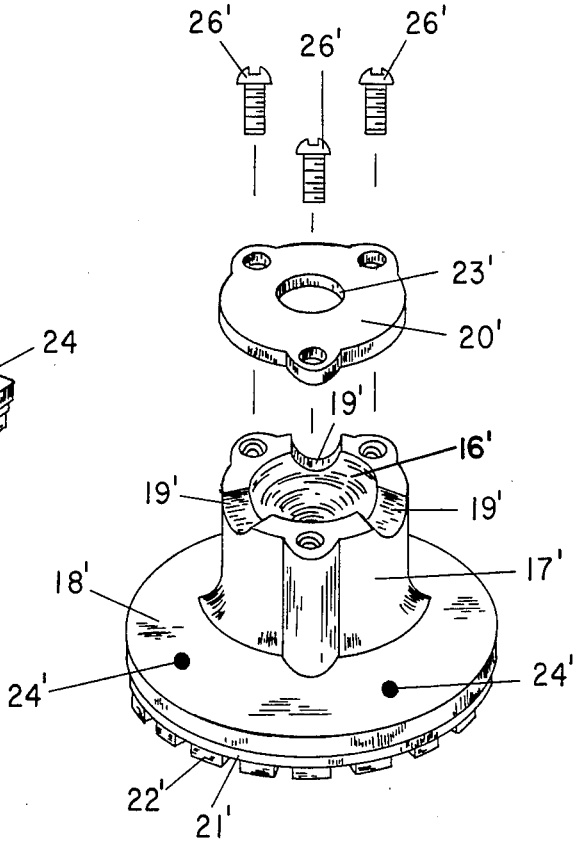
FIG. 8 is a perspective view of an alternative form of embodiment of the ladder foot.

FIG. 7 is a partially exploded perspective view of said foot 5 which depicts basically the orientation of the semi-spherical surface 16 with respect to the four horizontal semi-cylindrical bores 19 and to the metal keeper plate 20. FIG. 8 depicts an alternate form of embodiment of said foot 5 with the corresponding numbered components described herein identified by a "prime" symbol.

A ladder leveling device of my design provides a practical means to level a ladder as it is a simple matter for the typical user to understand the operation of the threaded shaft 4. It is constructed of fewer component parts as compared to devices of similar purpose, and it is an easy matter to mount on a typical metal ladder with I beam side rails as described above or can be just as easily attached to a ladder side rail of channel design. Further, being that the foot of a ladder is always in contact with the ground when in use, a pivotable ladder foot must be durable and must not be affected by such elements as moisture, dirt and other extraneous materials. The ladder foot 5 which I have described overcomes this problem because its main component part is capable of being manufactured with cast metal technology, is formed with horizontal openings near the top of the raised member 17 and does not require close manufacturing tolerances in order to maintain its pivot capability. For example said foot 5, described herein, is easily freed of extraneous material such as dirt by simply positioning the ladder to which it is attached so that the head 15 of the threaded shaft 4 is disengaged from the semi-spherical surface 16 and then either kicking or slightly rapping said foot 5 with a hammer, thus dislodging the material, allowing said material to exit via one of the horizontal openings 19. A device of my design is comprised mainly of four major components, three of which can each be cast in metal in one piece, thus simplifying its manufacture. Said foot 5 also could be adopted for use on other adjustable or stationary shafts similar to prior art previously referenced.

While the invention has been described with reference to specific embodiments, the description is illustrative and is not to be construed as limiting the scope of the invention. Various modification and changes may occur to those skilled in the art without departing from the spirit and scope of the invention as defined by the appended claims.

What is claimed is:

1. A device for leveling a ladder having side rails comprising:

a mounting bracket with a back attached to said rail a base attached to said back to provide support for the lower end portion of said side rail and a lateral member extending from said back formed with a threaded longitudinal bore at is distal end; and a threaded shaft sized to fit in said threaded bore and embodied with a convex semi-spherical head at its lower distal end and a handle at its upper distal end; and a pivotable foot further comprising a raised member, a bottom and a concave semi-spherical cavity within said raised member which provides a uniform point of contact for said semi-spherical head of said shaft while in engaged position; and a keeper plate attached to the top of said raised member of said foot with a hole formed at its center sized to both prevent said shaft from detaching from said foot and to allow pivotability of said foot with respect to said shaft, the size of said semi-spherical head is such than when in disengaged position provides a clearance between said convex head and said concave cavity; and horizontal openings near the distal end of said raised member will allow the free exit of foreign material from said concave semi-spherical cavity.

* * * * *